United States Patent [19]

Nakagawa et al.

[11] Patent Number: 4,846,897

[45] Date of Patent: Jul. 11, 1989

[54] PROCESS AND COMPOSITION FOR TREATMENT OF TITANIUM AND TITANIUM ALLOYS

[75] Inventors: Hiroyoshi Nakagawa; Eiichi Nishi, both of Osaka; Masanori Kanda, Tokyo, all of Japan

[73] Assignee: Nihon Parkerizing Co., Ltd., Tokyo, Japan

[21] Appl. No.: 194,374

[22] Filed: May 16, 1988

[30] Foreign Application Priority Data

May 16, 1987 [JP] Japan ..... 62-118099

[51] Int. Cl.[4] ..... C23C 22/34

[52] U.S. Cl. ..... 148/251; 148/269; 148/270

[58] Field of Search ..... 148/6.24

[56] References Cited

U.S. PATENT DOCUMENTS 4,004,064 1/1977 Kessler ..... 428/421

FOREIGN PATENT DOCUMENTS 4428697 12/1967 Japan .

*Primary Examiner*—Sam Silverberg

*Attorney, Agent, or Firm*—Ernest G. Szoke; Wayne C. Jaeschke

[57] ABSTRACT

A chemical conversion treatment solution for titanium or titanium alloy which comprises fluoride ions in a concentration of between about 5 to 40 g/l, a nitrate ion to fluoride ion weight ratio between about 0.005:1 to 0.2:1, a sulphate ion to fluoride ion weight ratio of between about 0.02:1 to 0.5:1 at least one metallic ion selected from the group consisting of Mg, Ca, Mn, Fe, Co, Ni, Zn and Mo in a weight ratio to fluoride ion between about 0.02:1 to 0.5:1, and at least one compound which is organochelate compound in a concentration of between about 0.1 to 2 g/l, a water-soluble organic high polymer in a concentration of between about 0.1 to 10 g/l, or a surfactant in a concentration of between about 0.01 to 3 g/l.

12 Claims, No Drawings

PROCESS AND COMPOSITION FOR TREATMENT OF TITANIUM AND TITANIUM ALLOYS

BACKGROUND OF THE INVENTION

1. Field of the Invention

The present invention relates to a process and composition for the surface treatment of titanium and titanium alloys. More particularly, the invention relates to a process for providing a surface film which facilitates the working of such materials.

2. Statement of Related Art

Fluoride-based treatment solutions are used as substrate conversion coating solutions for the formation of lubricating films on titanium or its alloys, for example, as described in U.S. Pat. No. 4,004,064 and Japanese Patent Publication No. 44-28967. The conversion coating solution disclosed in Japanese Patent Publication No. 44-28967 contains (1): hydrofluoric acid or alkali-fluoride, (2): sulfuric acid, nitric acid or an alkali salt thereof, and (3): a fluoride, sulfate or nitrate of a metal such as manganese, molybdenum or zinc. These compositions are used as a substrate for a lubricant for drawing work.

With the treatment solution of the invention disclosed in Japanese Patent Publication No. 44-28967, it is not possible to form a film that displays satisfactory adhesion during working if titanium or a titanium alloy is subjected to heavy and complex and/or high speed cold working. It has also been found that problems of seizure, etc. occur during cold working of titanium or a titanium alloy on which a lubrication film has been formed since there is considerable fluctuation in the quality of films.

DESCRIPTION OF THE INVENTION

Other than in the operating examples, or where otherwise indicated, all numbers expressing quantities of ingredients or reaction conditions used herein are to be understood as modified in all instances by the term "about".

In accordance with one aspect of the present invention a conversion coating treatment solution is provided for the formation of unexpectedly improved films and coatings on titanium and titanium alloys. Accordingly, the improved treatment solutions contains fluoride ions at a concentration of from 5 to 40 g/l in said treatment solution, a nitrate ions to fluoride ion weight ratio of 0.005:1 to 0.2:1, a sulfate ions to fluoride ions weight ratio of 0.02:1 to 0.5:1, one or more metal ions selected from the groups consisting of Ca, Mn, Fe, Co, Ni, Zn and Mo where the weight ratio of said metal ions to fluoride ions is between 0.02:1 to 0.5:1, at least one compound which is an organochelate compound at a concentration of between 0.1–2 g/l, a water-soluble organic high polymer compound at a concentration of between 0.1–10 g/l or a surfactant at a concentration of between about 0.01–3 g/l in the treatment solution. The pH of the treatment solution is preferably maintained between 1.5 to 5.0.

In accordance with another aspect, the process of this invention comprises a surface treatment for titamium or its alloy whereby clean titanium or its alloy is immersed in the above described solution which is maintained at a temperature of between 40° to 80° C. for a period between 3 to 15 minutes to form a chemical conversion coating thereon, followed by water rinsing and drying.

A conventional lubricant is then applied to the surface prior to working.

The fluoride ions are preferably supplied for the conversion coating solution by a fluorine compound that is selected from HF, bifluorides such as, for example, NaF.HF, KF.HF or $NH_4F.HF$, and fluorides such as, for example, NaF, KF or $NH_4F$. If the amount of F ions in the solution is less than 5 g/l, conversion coating characteristics become poorer than is necessary since the titanium or titanium alloy surface etching action is too weak. Conversely at more than 40 g/l the etching action is too strong and films with poor adhesivity are formed.

While a conversion film can be formed on Ti by the use of fluoride ions and pH adjustment as specified above, seizure can still occur very readily in cold working of titanium or a titanium alloy which has a lubrication film coated on such a conversion film. In the practice of this invention, we have found that the combination of acids, metal ions and organic compounds as specified above is critical to achieve the improvements of the present invention.

The $NO_3$ ions which are included as a necessary component in the treatment solution in accordance with the composition of the present invention are supplied by a compound selected from $HNO_3$ and nitrates such as, for example, $NaNO_3$, $KNO_3$ or $NH_4NO_3$.

The mechanism of formation of a conversion film on Ti is believed to be essentially the same as the mechanism in the case of Fe where Ti ions are produced through etching of the Ti. As a result of a reaction accompanied by production of $H_2$ at the Ti interface the Ti ions are deposited in the form of a compound on the Ti. There is, however, the drawback that $H_2$ produced will be absorbed by the Ti and cause hydrogen embrittlement thereof. Such hydrogen embrittlement is suppressed by $NO_3$ ions. If the $NO_3$ ion concentration relative to the F ions is less than 0.005, the $NO_3$ action of suppressing hydrogen embrittlement of the treated metallic Ti becomes weak; and the titanium or titanium alloy constituting the substrate becomes brittle and consequently the applied film becomes less adhesive. On the other hand, adhesivity also falls if the $NO_3$ ion concentration relative to the F ions exceeds 0.2. The concentration of $NO_3$ ions relative to the F ions is maintained at $NO_3/F=0.005:1$ to 0.2:1.

The $SO_4$ ions are supplied by a compound selected from $H_2SO_4$, sulfates such as, for example, $NaSO_4$ or $(NH_4)SO_4$, and corresponding bisulfates.

$SO_4$ ions are added so as to bring about an action by Mg, Ca and other metal ions in the treatment solution. As with $NO_3$ ions, the amount of $SO_4$ ions is specified relative to the amount of F ions and the ratio amount of $SO_4$ ions to the amount of F ions is maintained in the range 0.02:1 to 0.5:1. If this ratio is less than 0.02:1 film characteristics become poor since the solubility of metal ions in the treatment solution is poor and precipitation is likely to occur. On the other hand, if the ratio is greater than 0.5:1, the deposition of a Ti compound becomes weak and a coarse film with poor adhesivity is formed.

Metal ions can be supplied by selection of one or more carbonates, oxides or other compounds of Mg, Ca, Mn, Fe, Co, Ni, Zn and Mo.

It is thought that metal ions act as nuclei for deposition of the conversion film. It is necessary to have more than a minimum amount of metal ions in order to get full advantage of this but an excessive amount of metal ions hinders deposition of the main component constituted by the Ti compound. The amount of metal ions is specified relative to the amount of F ions, since the amount of Ti in the deposited Ti compound is more or less determined by the amount of F ions, which determines the amount of etching. The ratio of metal ions of F ions is maintained in the range of 0.02:1 to 0.5:1. If the ratio is less than 0.02:1 the result can be improper conversion coating since the amount of metal ions is too small, while if it is greater than 0.5:1 there is likely to be precipitation of metal ions and failure to produce a large amount of fine deposited nuclei.

Preferred examples of the organochelate compounds that are added in accordance with the present invention include gluconic acid, citric acid, tartaric acid, succinic acid, tannic acid, nitrilotriacetate acid (NTA), malic acid and similar organic acids as well as EDTA and the like.

The organochelate compound appears to improve conversion coating characteristics by increasing the effects of the metal ions but does not itself directly improve the adhesivity of the chemiformed film. We have discovered, in the practice of this tion, that the conversion films are improved only when the organochelate compound is employed in conjunction with metal ions in the treatment solution. For example, no improvement in film adhesivity was observed when the organochelate compound was added to a treatment solution in which metal ions were not present as specified herein. We have also found that the proper amount of organochelate compound is essentially independent of the amount of F ions.

The concentration of the organochelate compound in the treatment solution is preferably in the range 0.1–2 g/l. In this range the organochelate compound contributes to improvement of the chemiforming characteristics. One can expect practically no improvement of film forming characteristics at less than 0.1 g/l and no further increase in effects is brought about by increases above 2 g/l.

Examples of suitable water-soluble organic high polymer compounds in the present invention include preferably, polyvinyl alcohol, gelatin and polyvinyl pyrrolidine. The same phenomena of improved films as are observed with organochelate compounds are also observed in relation to the use of these high polymer compounds. That is, the film adhesivity is not improved by addition of a high polymer compound to a treatment solution in which metal ions are not present as specified herein. Improvement is noted only when the polymer is employed in conjunction with metal ions. The proper amount of high polymer compound is practically independent of the amount of F ions. The concentration of the high polymer compounds in the treatment solution is preferably between 0.1–10 g/l as the compound contributes to improvement of the film forming characteristics in this range. At less than 0.1 g/l there is no improvement, while at over 10 g/l there is a tendency toward poorer films.

Anionic, cationic, ampholytic or nonionic material may be employed as the surfactant but nonionic and ampholytic surfactants are particularly preferred. Preferred examples of nonionic surfactants include higher alcohol condensate types $(-O-(CH_2-CH_2-O-)_n-H)$, higher aliphatic acid condensate types, $(-CO-O-(CH_2-CH_2-O-)_n-H)$, higher aliphatic acid amide condensate types $(-CO.NH-(CH_2-CH_2-O-)_n-H)$, higher alkyl amine condensate types $(-NH-(CH_2-CH_2-O-)_n-H)$,

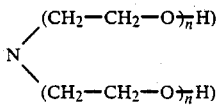

and alkyl phenol condensate types

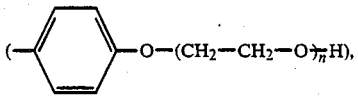

and the like. Betaine type surfactants, glycine type surfactants and alanine type surfactants may be employed as ampholytic surfactants. The concentration of surfactant in the treatment solution is preferably in the range between 0.1–3 g/l. In this range, the surfactant contributes to improvement of the film forming characteristics. No improvements are observed at less than 0.01 g/l, while more than 3 g/l is undesirable since there is no improvement and the burden in terms of wastewater treatment becomes that much greater since the treatment solution contains a surfactant at a higher concentration.

Again, the adhesivity is not improved by addition of a surfactant to a treatment solution in which metal ions are not present as specified herein; and the proper amount of surfactant is essentially independent of the amount of F ions.

One or more of the above noted organochelate compounds, water-soluble organic high polymer compounds and surfactant are included in limited concentration ranges in the treatment solutions of this invention.

The pH of the treatment solution is maintained at a value in the range 1.5 to 5.0 in accordance with this invention.

The pH is adjusted by means of an alkali such as ammonia or caustic soda, and the like, or by nitric, sulfuric, or hydrofluoric acid. If the pH is less than 1.5 the titanium or titanium alloy etching action becomes too strong and the result is a coarse film with poor adhesivity. At a pH over 5.0, it is difficult to form a satisfactory film. A preferred range is 2 to 3.5.

In the treatment of titanium or its alloy with the conversion coating solution in accordance with another aspect of this invention, the treatment solution is heated to 40° to 80° C., preferably in the range 45° to 55° C., and a film is formed by immersing titanium or a titanium alloy having a clean surface for 3 to 15 minutes. If the temperature of the treatment solution is lower than 40° C. the reactivity of the solution is too low, while if the temperature is higher than 80° C. the reactivity is excessively high; and both these cases are undesirable from the point of view of forming a good film. After completion of this treatment, the treated material is subjected to water rinsing, hot water rinsing or similar steps and then is dried.

Finally, a lubrication film is placed on the conversion coated titanium or its alloy employing molybdenum disulfate, metal soap, press oil, wax or resin material, or other known effective components.

The effects of the treatment solution are described as follows.

Uniform conversation coating films having excellent lubrication effects and adhesivity, which do not peel off even under heavy cold working, are formed by use of the treatment solution and methods of this invention. Furthermore, the films formed by use of these treatment solutions have a large number of fine pores which are suitable for receiving and holding added lubricant particles or droplets. Cold working characteristics are thus improved as a result of these improved properties which are directly attributable to the practice of the present invention.

EXAMPLES

Examples 1-3

Pure titanium wire rods 5.8 mm diameter and 5 m long were bright annealed, then the conversion treatment solution specified in Table 1 was applied followed by lubrication. The conversion coating was effected by immersing the titanium rods in the solution for 10 minutes at 52° C.±1° C.

Following withdrawal of the rods from the treatment solution, the rods were water rinsed, then subjected to a hot water rinse and finally treated with lubricant as specified in Table 2. Finally wire drawing was carried as in Table 3.

Comparison Example 1

Pure titanium wire rod 5.8 mm diameter and 5 m long was bright annealed and then was given the same lubrication treatment as in Example 1 but without being subjected to the conversion coating treatment of the present invention.

Comparison Example 2

A wire rod as in Comparison Example 1 was subjected to ordinary annealing and then the wire rod with scale adhering to it was given the same lubrication treatment as in Example 1.

Wire drawing was repeated in each of the noted conditions. However, passes were halted the moment seizure occurred.

Examples 4-5

The surfaces of 10.8 mm diameter, 2 m long pure titanium bars were polished and then subjected to the conversion coating of this invention in the same as in Example 1. The conditions of lubrication treatment following conversion coating treatment are noted in Table 4.

Comparison Examples 3-4

The surfaces of pure titanium bars (the same as above) were polished and then in Comparison Example 3 lubrication treatment was effected as in Table 4. In Comparison Example 4, lubrication was effected as indicated in Table 4 following the comparison conversion coating treatment specified in Table 1. Data is presented in Table 4 on the resulting performance during header processing of the above treated materials under the same conditions.

Examples 6-7

The surfaces of 30 mm diameter, 1 m long pure titanium bars were polished and then subjected to the conversion coating of this invention in the same way as in Example 1. The conditions of lubrication treatment following conversion treatment are noted in Table 5.

Comparison Example 5

The surface of bar material the same as above was polished and then subjected to the comparison conversion treatment as indicated in Table 1, following which lubrication treatment as indicated in Table 5 was also effected. The lubrication treatment conditions are noted in Table 5.

Data on the resulting performance when header processing was effected under the same conditions is noted in Table 5 together with the lubrication treatment.

Examples 8-9

After blast cleaning, 2.5 diameter, 7 mm thick Ti-3Al-2.5 V plates were subjected to conversion coating treatment as in Example 1. The conditions of lubrication following the chemiforming treatment are indicated in Table 6.

Comparison Example 6

After blast cleaning, plate material (the same as above) was subjected to the comparison conversion treatment of Table 1 and then lubrication treatment was effected in the same way as in Example 2.

Data on the resulting lubrication performance in cold forging of the above treated material under the same conditions is noted in Table 6 together with the lubrication conditions.

As seen from the above examples and comparison examples, use of the treatment solution and method of the present invention for treating titanium or its alloy results in the formation of a film possessing excellent and surprisingly improved film characteristics on the surface of such titanium material and this, together with subsequently effected lubrication treatment, gives excellent cold working characteristics.

TABLE 1

| Treatment solution materials | Example | | | Comparison Example | | |
|---|---|---|---|---|---|---|
| Composition | 1 | 2 | 3 | 4 | 5 | 6 |
| F g/l (NaF.HF) | 21.45(35) | 21.45(35) | 15.32(25) | 15.32(25) | 21.45(35) | 18.39(30) |
| $NO_3$ g/l ($NaNO_3$) | 0.8(1.1) | 0.5(0.69) | 0.8(1.1) | 0.6(0.82) | — | — |
| $SO_4$ g/l ($H_2SO_4$) | 6(6.1) | 5(5.1) | 5(5.1) | — | — | 4(4.08) |
| Mn g/l ($MnCO_3$) | 3(6.23) | — | 3(6.23) | 3(6.23) | — | |
| — | | | | | | |
| Zn g/l (ZnO) | 3(.72) | 2(2.48) | 3(3.72) | — | — | 2(2.48) |
| Total amount of metal ions (me) (g/l) | 3 | 5 | 3 | 3 | 3 | 2 |
| EDTA (g/l) | — | — | 0.7 | 0.5 | — | — |
| Polyvinyl alcohol (g/l) | 0.8 | — | 0.5 | — | — | — |

TABLE 1-continued

| Treatment solution materials | Example | | | Comparison Example | | |
|---|---|---|---|---|---|---|
| Composition | 1 | 2 | 3 | 4 | 5 | 6 |
| Citric acid (g/l) | — | 0.6 | — | — | — | — |
| Surfactant* (g/l) | — | — | 0.05 | — | — | — |
| pH (adjusted with NaOH) | 3.3 | 3.0 | 2.5 | 3.0 | 3.3 | 2.5 |

*Nonionic surfactant = polyoxyethylene - nonylphenol ether (EO 7 moles adduct) was used.

TABLE 2

| | Conversion treatment (Table 1) | Lubrication treatment | Lubrication performance |
|---|---|---|---|
| EXAMPLE | | | |
| 1 | Yes (Composition 1) | Coating with 20% MoS = Lubricant (manufactured by Nihon Atchison KK) | 3 passes good |
| 2 | Yes (Composition 2) | Coating with the above Lubricant following treatment with Palube 4612 (manufactured by Nihon Parkerizing KK) | as above |
| 3 | Yes (Composition 3) | Coating with Mo-containing metal soap following treatment with Palube 4612 | as above |
| COMPARISON EXAMPLE | | | |
| 1 | No | Same as Example 1 | Seizure on 2 passes |
| 2 | No | as above | as above |

TABLE 3

| Number of passes | Wire diameter | Cross-section reduction ratio | Drawing speed |
|---|---|---|---|
| 1 pass | 5.8–4.5 mm | about 40% | 10 m/min |
| 2 passes | 4.5–3.8 mm | about 28.7% | |
| 3 passes | 3.8–3.1 mm | about 33.4% | |

TABLE 4

| | Conversion treatment (Table 1) | Lubrication treatment | Lubrication performance |
|---|---|---|---|
| EXAMPLE | | | |
| 4 | Yes (Composition 1) | Treatment with Palube 235 (manufactured by Nihon Parkerizing KK) | No seizure |
| 5 | Yes (Composition 1) | Press oil (commercially available products) | as above |
| COMPARISON EXAMPLE | | | |
| 3 | No | Same as Example 4 | seizure occurred |
| 4 | Yes- (Composition 4) | Same as Example 5 | as above |

TABLE 5

| | Conversion treatment (Table 1) | Lubrication treatment | Lubrication performance |
|---|---|---|---|
| EXAMPLE | | | |
| 6 | Yes (Composition 1) | Same as Example 2 | No seizure |
| 7 | Yes (Composition 1) | Same as Example 3 | as above |
| COMPARISON | | | |

TABLE 5-continued

| | Conversion treatment (Table 1) | Lubrication treatment | Lubrication performance |
|---|---|---|---|
| EXAMPLE | | | |
| 5 | Yes (Composition 5) | Same as Example 2 | Seizure occurred |

TABLE 6

| | Conversion treatment (Table 1) | Lubrication treatment | Lubrication performance |
|---|---|---|---|
| EXAMPLE | | | |
| 8 | Yes (Composition 1) | Same as Example 2 | No seizure |
| 9 | Yes (Composition 1) | Same as Example 4 | as above |

TABLE 6-continued

| | Conversion treatment (Table 1) | Lubrication treatment | Lubrication performance |
|---|---|---|---|
| COMPARISON EXAMPLE | | | |
| 6 | Yes (Composition 6) | Same as Example 2 | Seizure occurred |

We claim:

1. A chemical conversion treatment solution for titanium or titanium alloy which comprises: fluoride ions in a concentration of between about 5 to 40 g/l, a nitrate ion to fluoride ion weight ratio between about 0.005:1 to 0.2:1, a sulphate ion to fluoride ion alloy which comprises: fluoride ions in a concentration of between about 5 to 40 g/l, a nitrate ion to fluoride ion weight ratio between about 0.005:1 to 0.2:1, a sulphate ion to fluoride ion weight ratio of between 0.02:1 to 0.5:1, at least one metallic ion selected from the group consisting of Mg, Ca, Mn, Fe, Co, Ni, Zn and Mo in a weight ratio to fluoride ion between about 0.02:1 to 0.5:1, and at least one compound which is an organochelate compound in a concentration of between about 0.1 to 2 g/l, a water-soluble organic high polymer in a concentration of between about 0.1 to 10 g/l, or a surfactant in a concentration of between about 0.01 to 3 g/l.

2. The composition of claim 1 in which the pH of said solution is between about 1.5 to 5.

3. The composition of claim 1 in which the pH of said solution is between about 2 to 3.5.

4. The composition of claim 1 in which said organochelate compound is selected from the group consisting of gluconic acid, citric acid, tartaric acid, succinic acid, tannic acid, nitrilotriacetic (NTA) acid, malic acid and ethylenediamine-tetraacetic acid (EDTA).

5. The composition of claim 1 in which said water soluble organic high polymer is selected from the group consisting of polyvinyl alcohol, gelatin and polyvinyl pyrrolidine.

6. The composition of claim 1 in which said surfactant comprises an anionic, cationic, ampholytic or nonionic surfactant.

7. The composition of claim 6 in which said surfactant comprises a nonionic surfactant.

8. The composition of claim 6 in which said surfactant comprises a ampholytic surfactant.

9. The composition of claim 6 in which said nonionic surfactant is selected from the group consisting of higher alcohol condensate types ($-O-(CH_2-CH_2-O-)_n-H$), higher aliphatic acid condensate types, ($-CO-O-(CH_2-CH_2-O-)_n-H$), higher aliphatic acid amide condensate types ($-CO.NH-(CH_2-CH_2-O-)_n-H$), higher alkyl amine condensate systems ($-NH-(CH_2-CH_2-O-)_n-H$),

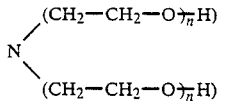

and phenol condensate types

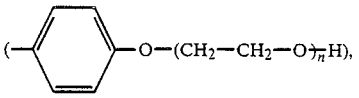

and the like.

10. The composition of claim 8 in which said amphylotic surfactant is selected from the group consisting of betaine type, glycine type and alanine-surfactants type.

11. A process which comprises: immersing clean titanium or titanium alloy in a chemical conversion treatment solution containing fluoride ions in a concentration of between about 5 to 40 g/l, a nitrate ion to fluoride ion weight ratio between about 0.005:1 to 0.2:1, a sulphate ion to fluoride ion weight ratio of between about 0.02:1 to 0.05:1, at least one metallic ion selected from the group consisting of Mg, Ca, Mn, Fe, Co, Ni, Zn and Mo in a weight ratio to fluoride ion between about 0.02:1 to 0.5:1, and at least one compound which is organochelate compound in a concentration of between about 0.1 to 2 g/l, a water-soluble organic high polymer in a concentration of between about 0.1 to 10 g/l, or a surfactant in a concentration of between about 0.1 to 3 g/l, maintained at a pH between about 1.5 to 5 at a temperature between about 40° to 80° C. for a period between about 3 to 15 minutes to form a conversion coating thereon.

12. The process of claim 11 in which said temperature is maintained between about 45° to 55° C.

* * * * *

UNITED STATES PATENT AND TRADEMARK OFFICE

CERTIFICATE OF CORRECTION

PATENT NO. : 4,846,897

DATED : July 11, 1989

INVENTOR(S) : Hiroyoshi Nakagawa, Elichi Nishi, Masanori Kanda

It is certified that error appears in the above-identified patent and that said Letters Patent is hereby corrected as shown below:

In Claim 1, at Column 9, line 17, "alloy which comprises: fluoride ions in a concentration of between about 5 to 40 g/l, a nitrate ion to fluoride ion weight ratio between about 0.005:1 to 0.2:1, a sulphate ion to fluoride ion" should be deleted.

In claim 10, at Column 10, line 28, after "alanine" add --type--.

In claim 10, at Column 10, line 28, after "surfactants" delete "type".

Signed and Sealed this

Twenty-fifth Day of February, 1992

*Attest:*

*Attesting Officer*

HARRY F. MANBECK, JR.

*Commissioner of Patents and Trademarks*